US006283544B1

(12) United States Patent
Alcala et al.

(10) Patent No.: US 6,283,544 B1
(45) Date of Patent: Sep. 4, 2001

(54) COAT RACK WITH SEAT ASSEMBLY

(75) Inventors: Jose Alcala, Fayettevill, AR (US); Sofia Dumery; Sun Chul Kim, both of Brooklyn, NY (US); Kimberly Leonard, Washington, DC (US); Andrew Schloss, New York, NY (US)

(73) Assignee: ABC School Supply, Inc., Duluth, GA (US)

( * ) Notice: Subject to any disclaimer, the term of this patent is extended or adjusted under 35 U.S.C. 154(b) by 0 days.

(21) Appl. No.: 09/479,081

(22) Filed: Jan. 7, 2000

Related U.S. Application Data

(63) Continuation-in-part of application No. 29/100,175, filed on Feb. 4, 1999, now Pat. No. Des. 436,263.

(60) Provisional application No. 60/115,741, filed on Jan. 13, 1999.

(51) Int. Cl.[7] ..... A47B 83/00

(52) U.S. Cl. ..... 297/188.1; 297/188.03; 297/232; 211/90.01; 312/235.4; 312/235.5

(58) Field of Search ..... 297/188.1, 188.03, 297/232; 211/88.01, 90.01; 312/235.2, 235.3, 235.4, 235.5, 235.9

(56) References Cited

U.S. PATENT DOCUMENTS

| | | | | |
|---|---|---|---|---|
| D. 412,625 | | 8/1999 | Montague, III et al. | D6/421 |
| 1,341,106 | * | 5/1920 | Booth | 312/235.2 X |
| 1,688,834 | * | 10/1928 | Sharp | 312/235.3 |
| 2,808,170 | * | 10/1957 | Bernhard | 297/188.1 X |
| 5,718,475 | * | 2/1998 | Watts | 297/188.1 X |

FOREIGN PATENT DOCUMENTS

| | | | | |
|---|---|---|---|---|
| 977902 | * | 4/1951 | (FR) | 312/235.4 |
| 36156 | * | 5/1954 | (PL) | 312/235.4 |

OTHER PUBLICATIONS

"angeles Baseline Furniture" 055–6 (18) 61—p. 21 of ABC School Supply General Catalog—1996.
"Korners For Kids Bench Coat Locker"—p. 19 of ABC School Supply General Catalog—1996.
"Korners For Kids Toddler Bench Coat Locker" 008–50561—p. 19 of ABC School Supply General Catalog—1996.
"Combination Locker" 806–6 () 61—p. 16 of ABC School Supply General Catalog—1996.
"Maple Korners For Kids Bench Coat Locker" 260–16561—p. 5 of ABC School Supply General Catalog—1996.
"Korners For Kids Wall Mounted Coat Locker" 067–45766/167–70366—p. 4 of ABC School Supply Cool Summer Savings Catalog—1996.
"Korners For Kids Toddler Bench Coat Locker"—008–50566/008–30366—p. 4 of ABC School Supply Cool Summer Savings Catalog—1996.
"Korners For Kids Bench Coat Locker" 108–14562/108–80362—p. 11 of ABC School Supply Catalog—1996.
"Korners For Kids Toddler Bench Coat Locker" 008–50562/008–30362—p. 11 of ABC School Supply Catalog—1996.
"Maple Korners For Kids Bench Coat Locker" 260–16562—p. 3 of ABC School Supply Catalog—1996.

* cited by examiner

*Primary Examiner*—Peter R. Brown
(74) *Attorney, Agent, or Firm*—Womble Carlyle Sandridge & Rice

(57) ABSTRACT

The present specification discloses a children's furniture comprises a plurality of stalls, each stall defined by three walls and sharing a common wall with an adjacent stall. Each stall has a shelf, coat hooks, a seat and a storage area. Children can sit on the seat to put on and remove their shoes, and will store their shoes in the storage area under the seat. They can also hang their coats on the hooks provided here, and put their books and other belongings on the shelves.

9 Claims, 3 Drawing Sheets

COAT RACK WITH SEAT ASSEMBLY

CROSS REFERENCE TO RELATED APPLICATIONS

This application is a continuation in part of the U.S. patent application Ser. No. 29/100,175 filed on Feb. 4, 1999, and issued as Design Pat. No. D436,263 issued Jan. 16, 2001 and claims priority to U.S. provisional application U.S. Ser. No. 60/115,741 filed on Jan. 13, 1999.

TECHNICAL FIELD

The present invention generally relates to children's furniture. More particularly, the present invention relates to coat racks for school and like use.

BACKGROUND

Children generally are not very organized or concerned with their clothing and footwear. They leave clothes and shoes wherever they remove them and generally do not hang up clothes, often leaving a mess for parents, if they are at home, or teachers, if they are at school to pick up after them. Parents and teachers, however, often have a difficult time teaching children to properly put away and/or hang up their clothes, because they either do not have a designated space for children to place their clothing and shoes or, even, when there is a designated place, it is usually designed for adult use and is hard for children to reach and not always safe for children's use.

Another common problem for children in a household setting, school or daycare center, is the fact that there often is no proper seating places for them to put on their shoes. Instead children usually sit on the floor with their belongings scattered all around them while they are putting on their shoes, thus making an even greater mess in their surroundings. These problems are accentuated in situations where there are many children gathered, such as schools or daycare centers, or even in a household setting when there are many children gathered for a party.

Therefore, it can be seen that there is a need for furniture designed specifically for children, where they can hang their clothes, store their gloves and put their shoes and other belongings, that solves these and other related and unrelated problems in the art.

SUMMARY

Briefly described, the present invention generally comprises a coat rack with seat assembly designed and built to be used by children, wherein the seat assembly includes a movable seat and an enclosed and selectively accessible storage chamber under the seat The seat performs the dual function of a sitting platform and a movable lid for access to the otherwise enclosed storage chamber. The seat assembly is designed and constructed to minimize the risk of injuring a child's finger when the child stores his/her gloves and other items in the storage chamber under the seat. This coat rack with seat assembly defines a plurality of storage zones and areas which can be used by children to store their shoes, boots, gloves, books, and coats so they can learn how to keep their surroundings organized, keep track of their belongings and keep their belongings clean, for example, by not mixing wet boots with gloves or coats. Using this coat rack with seat assembly, parents and teachers can teach children how to be organized and to take care of possessions such as clothing by hanging coats or the like on the racks and storing their gloves and other belongings in the storage area after they have been removed. This furniture also helps to keep schools and daycare centers organized by having children store their belongings out of sight and out of the way.

In a preferred embodiment, the coat rack with seat assembly generally includes a plurality of stalls mounted adjacent each other, and each stall has a seat assembly including a seat and storage chamber. In a preferred embodiment, each stall typically has three walls defining a vertically elongated cavity, an upper shelf, and a seat assembly with a storage chamber. The coat rack with seat assembly is acceptably made from wood, metal, plastic or similar durable, sturdy material. In a preferred embodiment, the seat assembly comprises a seat that is pivotally attached to the rack frame, a seat support and a storage chamber. The seat has a handle that extends away from the seat support a sufficient distance so that a child's hand on the handle is not likely to be impacted or be caught between the seat and the seat support. The support further has rubber stoppers to support the seat and a recess in its center position, such that the area that poses any danger for catching children's finger between the seat and the seat support is minimized. The seat further projects over the storage chamber under the seat to a position in the front of the seat such that, when the seat is swung down to close the storage chamber, the risk of a child's finger becoming caught and/or stuck between the seat and the seat support is minimized The coat rack further has a plurality of hooks mounted onto the walls for hanging clothing and upper items.

Various objects, features, aspects, and advantages of the present invention will become better understood with reference to the following figures, description and appended claims.

DETAILED DESCRIPTION

Figure 1:
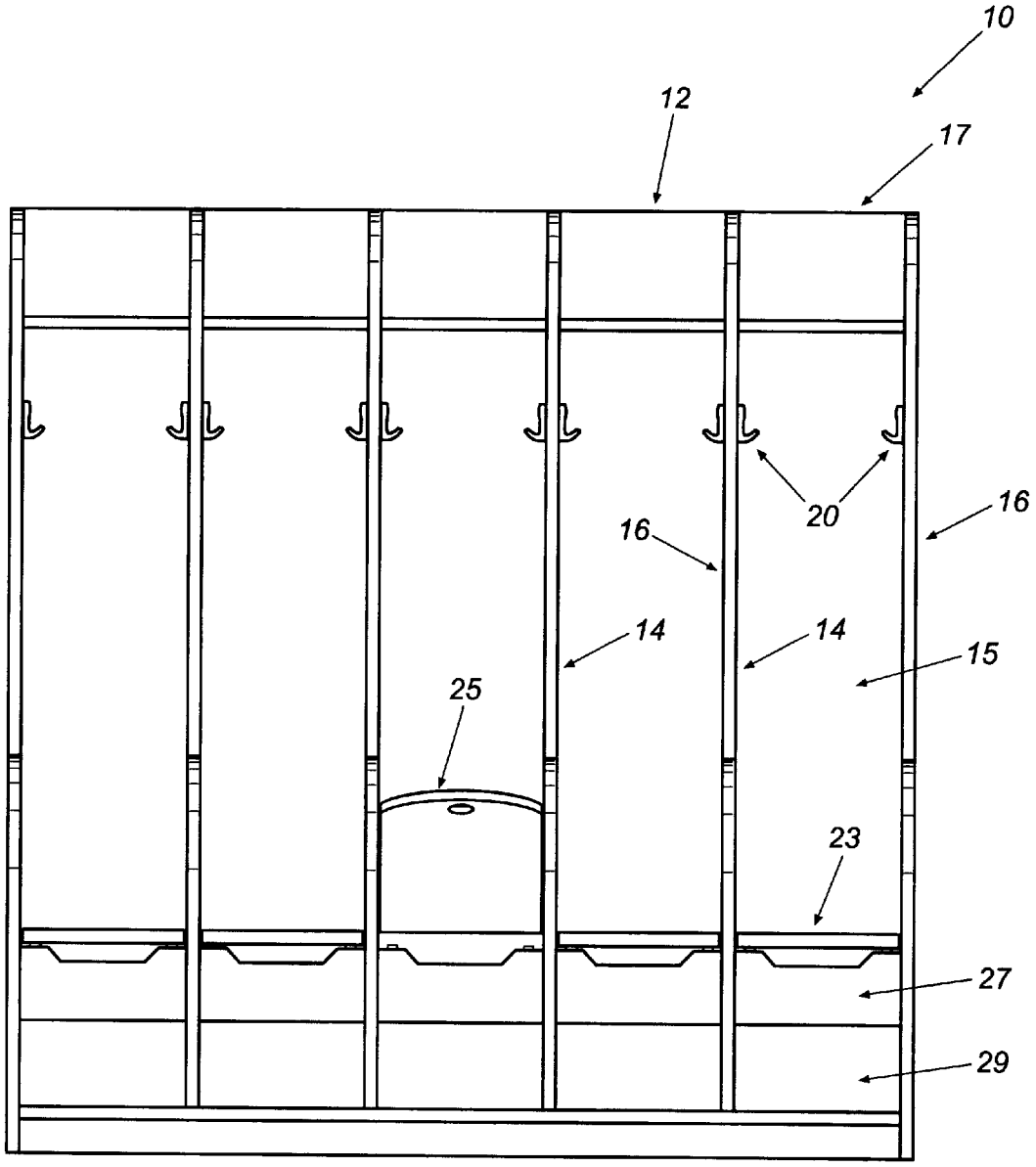
FIG. 1 is a front elevational view of the coat rack with seat assembly.

Referring now in more detail to the drawings in which like numerals refer to like parts throughout the several views, FIG. 1 generally illustrates the preferred embodiment of a coat rack with seat assembly 10 for use by children in schools, daycare centers, or wherever a large number of children gather. The coat rack with seat assembly 10 will provide the opportunity for parents and teachers to teach children how to be organized and care for their belongings by providing them with proper places to store their books or hats on the upper shelf hang their coats on coat hooks, store their gloves (and hats) and other items in the storage chamber under the seat, and store their shoes in the storage area under the storage chamber of the seat assembly. The coat rack with seat assembly 10 also provides a seat for children to use while putting on their shoes. The coat rack with seat assembly 10 preferably comprises a plurality of stalls 12, e.g., preferably 2–5 stalls arranged in series, connected side by side sharing a common wall. It will be understood that the number of stalls can vary depending upon the desired size and configuration of the coat rack with seat assembly 10. Each stall generally has three walls 14, 15, 16, an upper shelf 17, at least one coat hook 20 attached on one of the walls 14, 15, 16, a seat assembly 23 having a seat 25, a storage chamber 27 under the seat 25 and an open storage area 29 under the seat assembly 23 for storing shoes.

Figure 2:
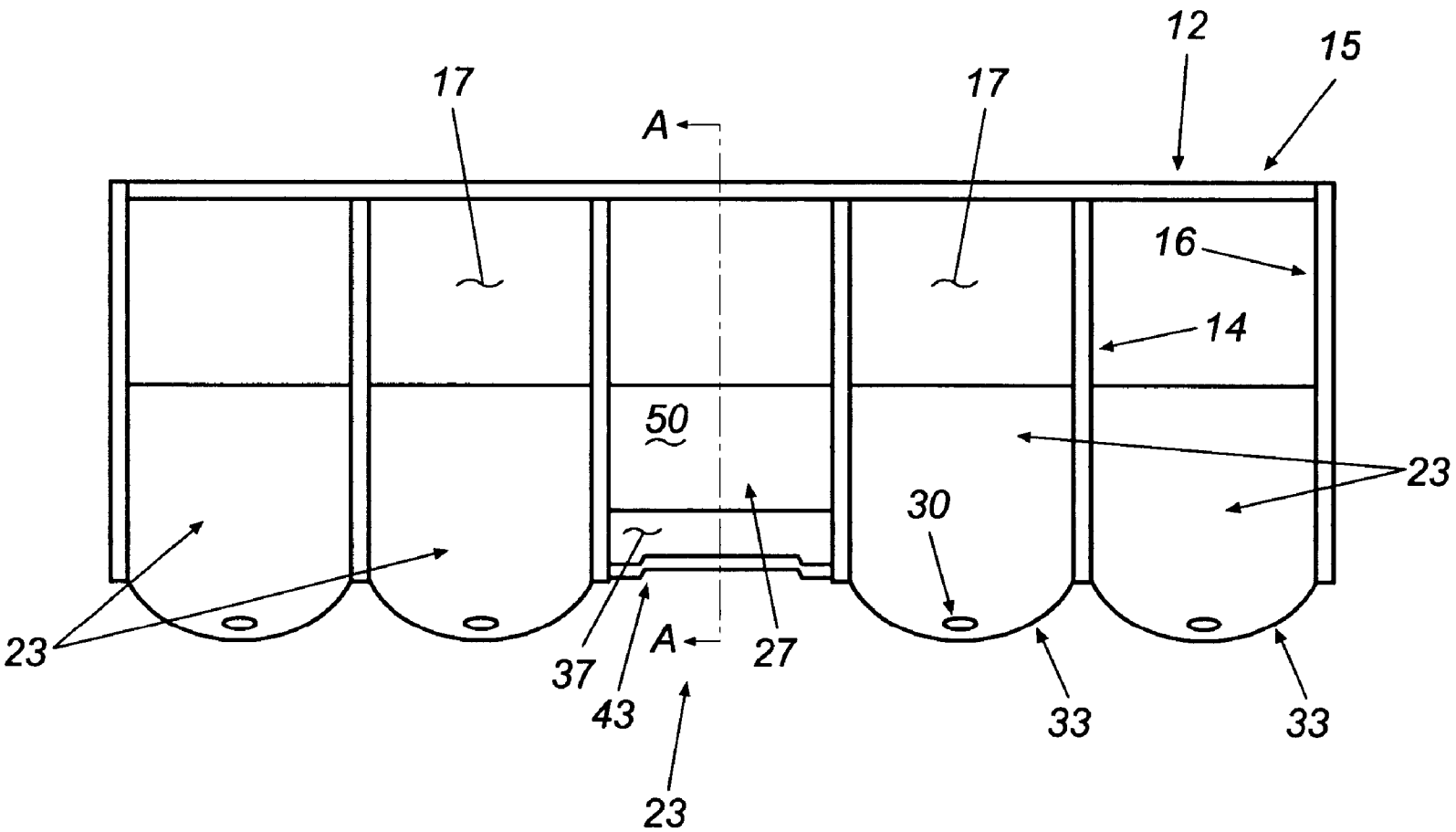
FIG. 2 a plan view of the coat rack with seat assembly.

The stalls 12 are partially enclosed by three walls 14, 15, 16 so as to define open ended chambers or recesses for storage. The walls 14, 15, 16 generally are made from wood, metal or a plastic material. A plurality of coat hooks 20 made, for example, from wood, metal or a plastic material are mounted onto the walls using a mounting means such as glue, screws, nails, or other similar mounting means. As further shown in the preferred embodiment of FIG. 2, the rear wall 15 is formed as a common rear wall for each stall 12 while the side walls 14 and 16 are generally shared between two adjacent stalls 12.

The upper shelf 17 typically is an open area for storage where children can put their books or hats and other belongings onto the shelf 17. The upper shelf 17 is mounted onto the walls 14, 15, 16, generally supported by brackets (not shown) or other supporting/fastening means. In an alternate embodiment, additional shelves (not shown) are added to each stall 12 as desired for defining additional separated storage areas.

Figure 3:
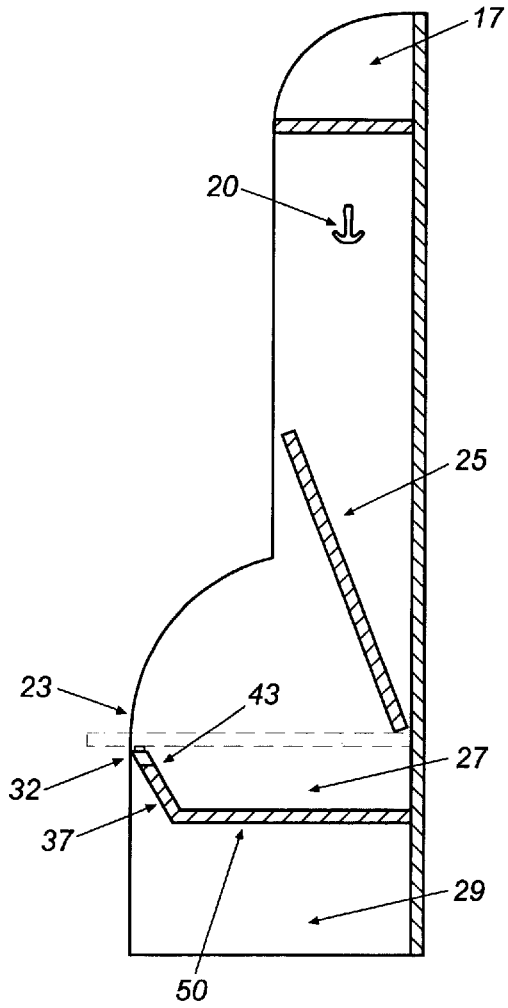
FIG. 3 a cross-section view taken along line AA in FIG. 2.

Referring now to FIG. 3, the seat assembly 23 is a generally rectangular shaped unit or cabinet enclosed on at least three sides by the walls 14, 15, 16 and having a seat 25, a seat support 32 and a storage chamber 27 beneath the seat 25. The seat 25 is attached to the seat assembly 23 through hinges (not shown) to enable it be moved between open and closed positions, thus allowing access to the storage chamber 27. The seat 25 also, preferably has a handle 30 (FIG. 2) for use by a child to lift the seat 25 to its open position. The seat 25 and the handle are extended away from the seat support 32 so that a child's hand on the handle 30 will likely not be impacted or be caught between the seat support 32 and the seat 25. The seat 25 also preferably has a curved front face 33 with its edges rounded. The seat 25 can be optionally equipped with soft cushions (not shown). By lifting the seat 25, a child would have total access to the storage area 27.

Figure 4:
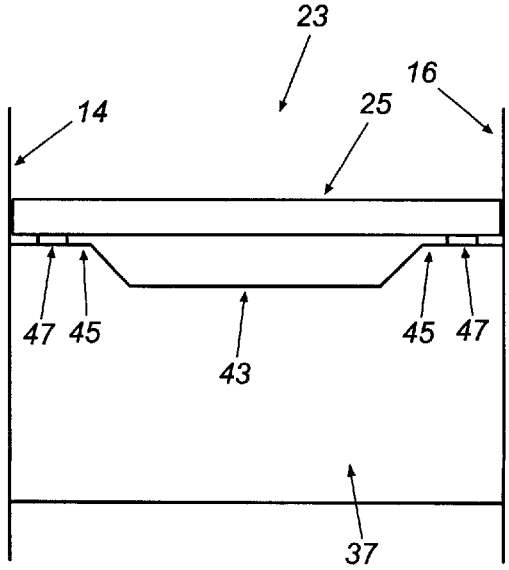
FIG. 4 is a detail front elevational view of the frontal panel recess.

The seat support 32 comprises a front panel 37 mounted onto surrounding walls 14, 15, 16. A recess 43 is provided in the front panel 37 such that only a portion or section 45 of the front panel 37 close to the walls 14 and 15 of the stalls 12, where there are a plurality of stoppers 47, is in direct contact with the seat 25 as it is shown in FIG. 4. Such construction minimize the chance of pinching children's fingers when the seat 25 is shut closed. The length of the recess 43 is a function of the rigidness of the seat material. The more rigid the material, the wider the recess 43 can be. The stoppers 47 are made of rubber, plastic or similar material and are located between the front panel 37 and the seat 25 when the seat is in a closed position as shown in FIG. 4. The stoppers 47 soften the contact between the seat 25 and the seat support 31 and create a gap at the pinch points between the front panel outer sections 45 and the seat 25.

The storage chamber 27 is located under the seat 25 and defined by one bottom panel 50 mounted onto surrounding walls 14, 15, 16, the seat support 37 and the surrounding walls 14, 15, 16 as can be seen in FIG. 3.

The bottom panel 50 and the three surrounding walls 14, 15, 16 further define an open storage area 29 for shoes beneath the storage chamber 27. Shoes, for example, can be slid easily into this open storage area 29.

In an alternate embodiment, the upper shelf 17 is an enclosed unit having at least one door and optionally a lock. In this embodiment, children will open the door before they put their books and gloves on the shelf 17 and can then close and lock their belongings therein.

In use, the coat rack with seat assembly 10 presents itself attractively to children as a dedicated place for their use, where they can sit side by side with their friends, when they are putting on or removing their shoes, and where they can store separately their belongings, such as shoes, books, gloves, etc.. The seat and the storage chamber 27 are designed to be used safely by children, whereby the chance of their fingers being pinched by the seat 25 is minimized. Adults can use this rack as a tool to teach children how to be organized. Parents and teachers can instruct children to, for example, put shoes in the open storage area 29 after they are removed, to hang their coats on the coat hooks 20, to put their gloves and knit hats in the storage area 27, and to store their books, back packs, and other items on the shelves 17.

Although the present invention has been described with reference to certain preferred embodiments thereof, it will be understood by those skilled in the art that numerous variations, additions, modifications and substitutions also can be made to the present invention. Therefore, the spirit and scope of the patent claims should not be limited only to the description of the preferred versions contained herein.

What is claimed is:

1. A storage and seating apparatus, comprising:

at least a first stall member including a back wall and two opposing side walls defining a vertically elongated stall cavity having a generally open front;

a seat assembly supported by said stall member and positioned within said stall member to divide said stall cavity into an upper storage cavity and a lower storage cavity, and including a seat movable between an opened position and a closed position, and a chamber bottom panel positioned below said seat, wherein said seat, said bottom panel and said walls of said stall member define an enclosed and selectively accessible storage chamber, said seat providing access to said chamber when in said open position, and preventing access to said chamber when in said closed position, whereby the storage and seating apparatus defines at least two open storage areas and a third, enclosed and selectively accessible storage chamber.

2. The apparatus of claim 1, wherein said chamber bottom panel includes:

a base member extending from said back wall of said stall member toward the open front of the cavity;

and a front member extending from said base member in an upward direction, said front member providing a support surface for said seat.

3. The apparatus of claim 1, wherein said front member of said chamber bottom panel defines:

an upper edge extending between said opposing side walls of said stall member and a recess defined in said upper edge intermediate said opposing side walls, whereby said upper edge is defined by two opposed seat support sections and a recessed section.

4. The apparatus of claim 3, further comprising a stopper mounted to each of said seat support sections.

5. The apparatus of claim 1, further comprising a shelf member supported by said stall member above said seat assembly, further dividing said stall, member upper storage cavity into a first upper storage area and a second upper storage area.

6. The apparatus of claim 5, further comprising hook members supported by at least one of said walls of said stall member.

7. The apparatus of claim 1, further comprising hinges connecting said seat to at least one of said walls of said stall members, whereby said seat is pivotably movable from the open position to the closed position.

8. The apparatus of claim 1, further comprising hook members supported by at least one of said walls of said stall member.

9. The apparatus of claim 1, further comprising:

a plurality of stall members, each stall member of said plurality of stall
members including
a back wall and two opposing side walls defining a vertically elongated stall cavity having a generally open front,
wherein said back wall of each said stall member is a common back wall being common to all said stall members, and
wherein adjacent ones of said stall members share a common side wall; and
a seat assembly supported by each said stall member and positioned within the respective
said stall member to divide said stall cavity into in upper storage cavity and a lower storage cavity, and including
a seat movable between an opened position and a closed position, and
a chamber bottom panel positioned below said seat,
wherein said seat, said bottom panel and said walls of each said stall member define an enclosed and selectively accessible storage chamber, said seat providing access to said chamber when in said open position, and preventing access to said chamber when in said closed position,
whereby the storage and seating apparatus defines a plurality of side-by-side stall members, each having at least two open storage areas and a third, enclosed and selectively accessible storage chamber, and each having a seat movable to provide access to the enclosed storage chamber.

* * * * *